US012704048B2

(12) United States Patent
Nguyen et al.

(10) Patent No.: US 12,704,048 B2
(45) Date of Patent: Aug. 11, 2026

(54) CASING EXIT ASSEMBLY, METHOD, AND SYSTEM

(71) Applicant: Baker Hughes Oilfield Operations LLC, Houston, TX (US)

(72) Inventors: Tuan Nguyen, Pearland, TX (US); James Scott Trahan, Magnolia, TX (US); David Alexander, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/782,826

(22) Filed: Jul. 24, 2024

(65) Prior Publication Data

US 2026/0028899 A1 Jan. 29, 2026

(51) Int. Cl.
*E21B 43/10* (2006.01)
*E21B 7/06* (2006.01)

(52) U.S. Cl.
CPC ..... *E21B 43/10* (2013.01); *E21B 7/061* (2013.01)

(58) Field of Classification Search
CPC ..... E21B 7/061; E21B 43/10
See application file for complete search history.

(56) References Cited

U.S. PATENT DOCUMENTS

2019/0093436 A1* 3/2019 Costa de Oliveira ..... E21B 23/0412
2022/0243548 A1* 8/2022 Infante ..... E21B 31/20
2023/0069763 A1* 3/2023 Maher ..... E21B 41/0085
2023/0129281 A1* 4/2023 Nguyen ..... E21B 23/01 166/55.7
2025/0003302 A1* 1/2025 Alshehri ..... E21B 17/021

* cited by examiner

*Primary Examiner* — Tara Schimpf
*Assistant Examiner* — Lamia Quaim
(74) *Attorney, Agent, or Firm* — Baker Hughes Company

(57) ABSTRACT

A casing exit assembly, including a whipstock, a mill releasably attached to the whipstock, the mill including an initiation sensor and a drive, and an anchor attached to the whipstock, the anchor including a housing with a ramp, a slip disposed to move radially of the housing upon axially transitioning on the ramp, and an interlock operably attached to the driver. A method for managing a casing exit, including running the casing exit assembly to a target location in a borehole, sensing a pressure within or around the assembly, imposing a tensile load on the interlock, releasing the interlock, moving the slip with a drive plate of the interlock, and setting the slip. A borehole system, including a borehole in a subsurface formation, a string disposed in the borehole, and a casing exit assembly, disposed within or as a part of the string.

15 Claims, 8 Drawing Sheets

CASING EXIT ASSEMBLY, METHOD, AND SYSTEM

BACKGROUND

In the resource recovery and fluid sequestration industries It is often necessary to exit a casing in order to prepare a lateral borehole. This is commonly accomplished by using a whipstock assembly including an anchor to direct a mill into a wall of a casing and a desired location to mill through that casing and then drill out into the formation. While a number of different types of assemblies are available for such operations, they remain less than optimally efficient due to various conditions that are commonly experienced. Increased efficiency is always desirable in the art.

SUMMARY

An embodiment of a casing exit assembly, including a whipstock, a mill releasably attached to the whipstock, the mill including an initiation sensor and a drive, and an anchor attached to the whipstock, the anchor including a housing with a ramp, a slip disposed to move radially of the housing upon axially transitioning on the ramp, and an interlock operably attached to the driver.

An embodiment of a method for managing a casing exit, including running the casing exit assembly to a target location in a borehole, sensing a pressure within or around the assembly, imposing a tensile load on the interlock, releasing the interlock, moving the slip with a drive plate of the interlock, and setting the slip.

An embodiment of a borehole system, including a borehole in a subsurface formation, a string disposed in the borehole, and a casing exit assembly disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
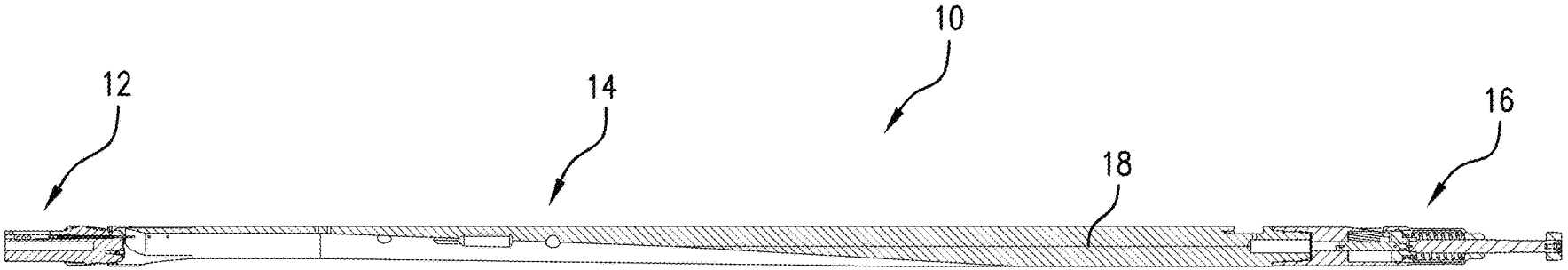
FIG. 1 is a sectional view of a casing exit assembly as disclosed herein.

Referring to FIG. 1, a casing exit assembly 10 is illustrated in cross section. The view is most useful to understand positioning of the various components discussed hereunder.

A mill 12 is that a left side of the figure and secured to a whip stock 14. The whipstock extends to a right side of the figure where it is secured to an anchor 16. It is to be appreciated in FIG. 1 that a cable or other tether 18 extends from within the mill 12 to within the anchor 16. Connections for, and function of, the cable 18 are addressed further with regard to FIGS. 2 through 5.

Figure 2:
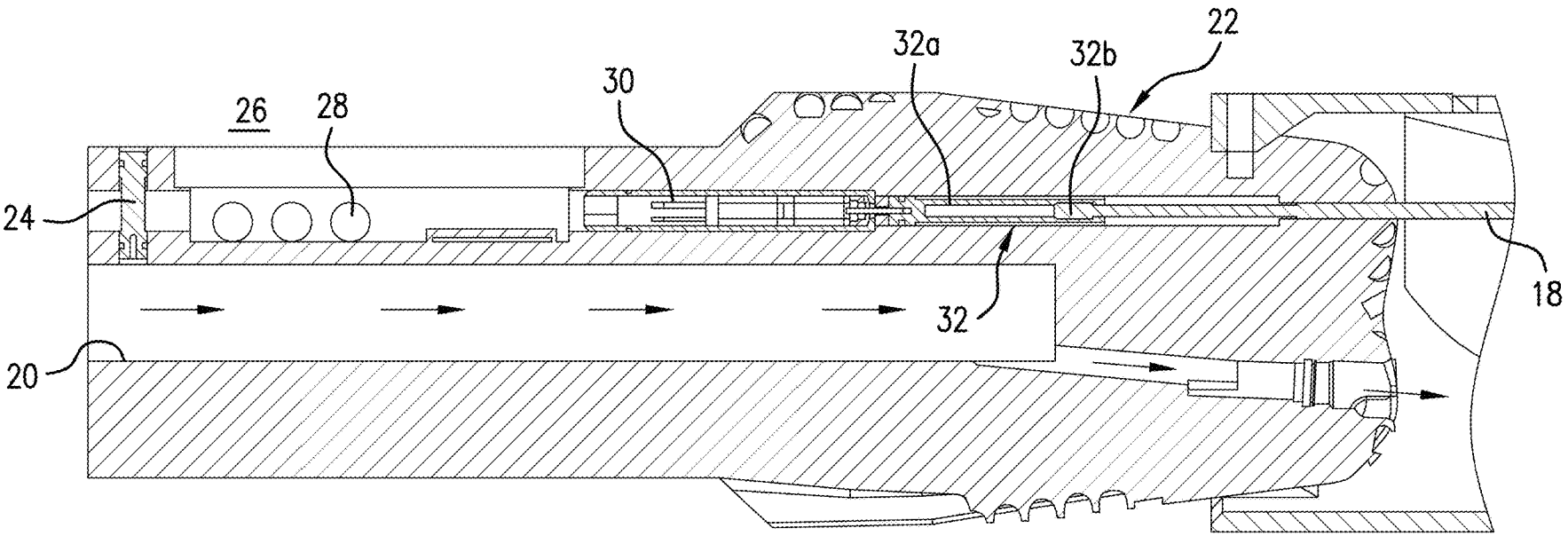
FIG. 2 is an enlarged portion of FIG. 1 illustrating a mill of the casing exit assembly.

Referring to FIG. 2 and enlarged view of the mill 12 of the casing exit assembly 10 is illustrated in cross section. The mill 12 is of tubular construction having an inside diameter bore 20. The mill further comprises the cutting head 22, which will be familiar to those of ordinary skill in the art. Unusual about mill 12 is an initiation sensor 24, which may, in some embodiments, be a pressure sensor, configured to be exposed to the bore 20, to an annular space 26 outside of the mill 12, or both. Sensor 24 may, for example, be configured to sense pressure within the bore 20, in the annular space 26, or both. Sensor 24 is connected to an electronics package 28 configured to read a signal generated by the sensor 24 and then take action when a threshold is reached. A selected threshold may be reached by application of pressure from a remote or uphole location or may be reached in other ways, such as, for example, closing a blowout preventer to allow pressure to build within the borehole. The electronics package 28 may include batteries as well as other components. The electronics package 28 is operatively connected to an electric motor assembly 30 disposed in the mill 12, which motor assembly 30 includes a rotary to linear motion conversion device 32, such as, for example, a leadscrew-type device where a female portion 32*a* is internally threaded and a male portion 32*b* is externally threaded. The conversion device 32 is connected to the cable 18, which then extends along the whipstock 14 and into the anchor 16.

Figure 3:
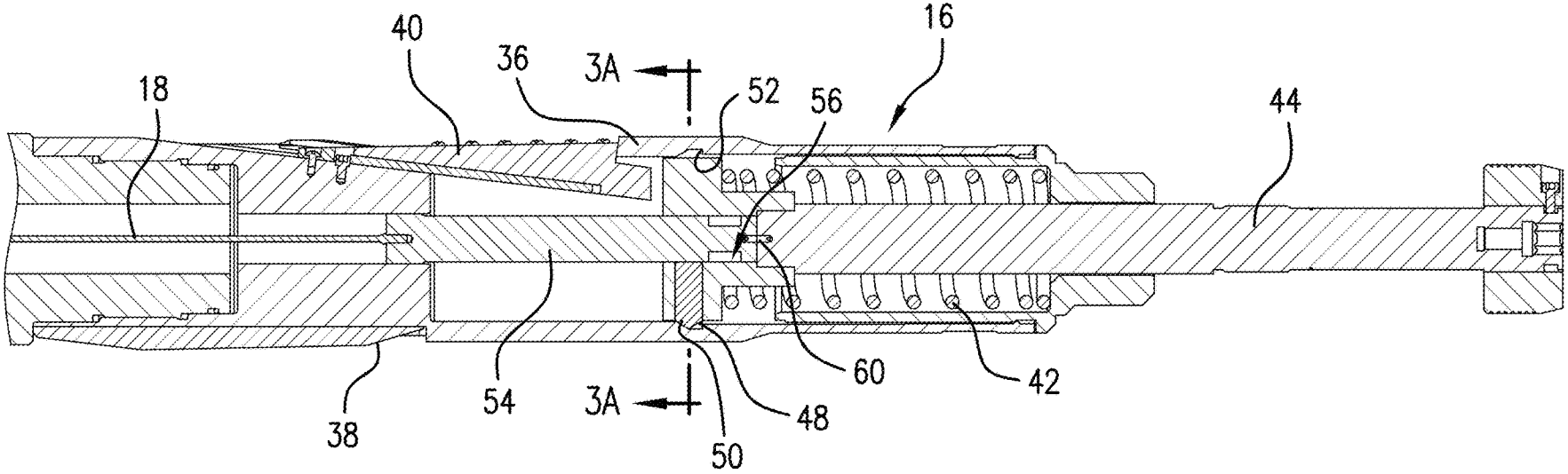
FIG. 3 is and enlarged portion FIG. 1 illustrating an anchor of the casing exit assembly.
Figure 3A:
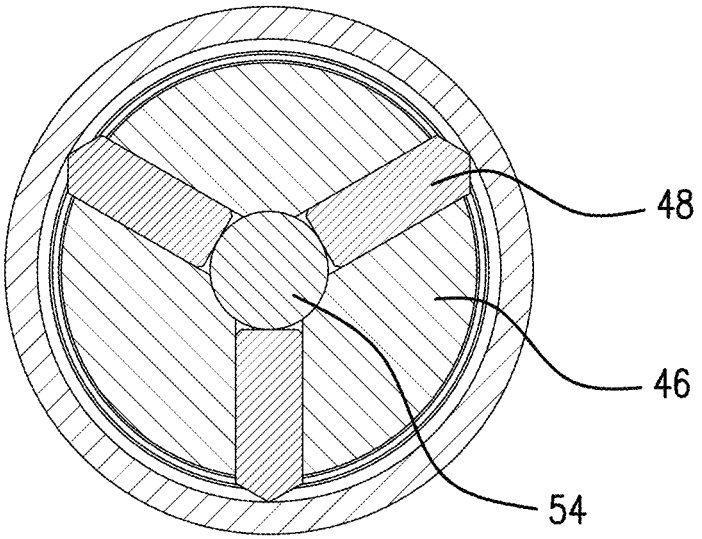
FIG. 3A is a cross-sectional view a FIG. 3 taken along section line 3A-3A.
Figure 4:
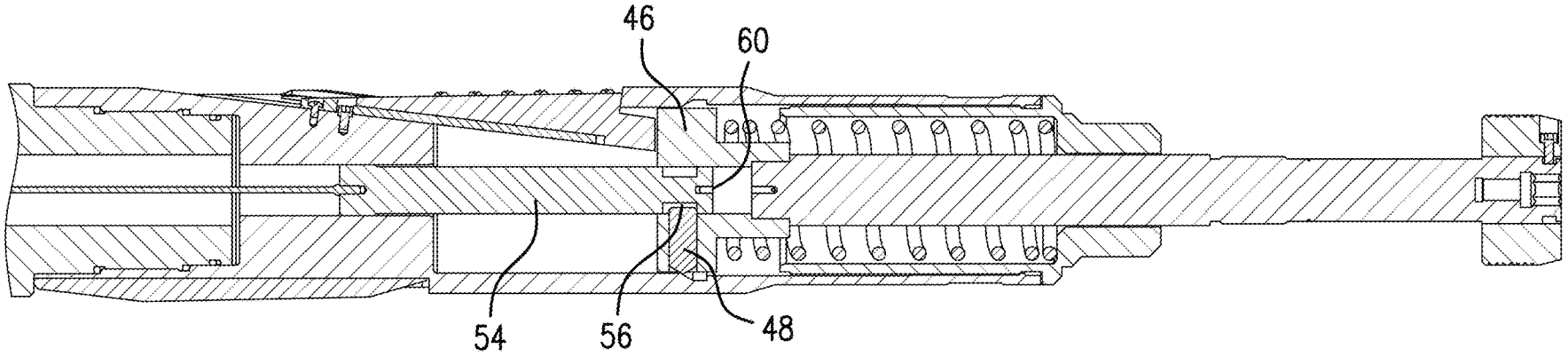
FIG. 4 is a view of the anchor with the interlock disengaging from the housing.

Referring to FIGS. 3 and 4, a better view of the anchor 16 is provided. The anchor 16 includes an anchor housing 36, which housing provides a ramp 38 that is in operable communication with a slip 40 such that axial translation of the slip 40 along the ramp 38 causes the slip 40 to move radially into and out of a set position. Moving the slip 40 to the left of the drawing will put the slip in the set position while moving the slip to the right of the drawing will put the slip in the unset position. In the embodiment of FIG. 4, the anchor 16 is configured to primarily use a power spring 42 to set the slip 40, but also contains a drive bar 44 that may be used to set the slip based on set down within the borehole. Movably disposed within the housing 36 is a drive plate 46 that is disposed contact with the power spring 42. The drive plate 46 includes one or more interference pins 48 that are slidably disposed within the housing 36. Most easily appreciated in FIGS. 3 and 4 is recess 52 (one or more) in the housing 36 which recess will accept a tip 50 of the interference pins 48 to thereby lock the drive plate 46 in place relative to the housing when the pins 48 are prevented from radially inward movement. Pins 48 are prevented from radial movement by an interference bar 54 that extends at least partially into the drive plate 46, and includes a recess 56 that when aligned with the pins 48 will allow radial movement of those pins 48 such that they will disengage with recess 52.

Comparing FIGS. 3 and 4 it will be apparent that the interference bar 54 has changed position. The position change includes a release of release member 60 that connects the interference bar 54 to the drive bar 44. The release is a result of the tensile load placed upon the interference bar 54 by the cable 18. The cable 18 is configured for transmitting the tensile load generated by the motor assembly 30 and conversion device 32. With displacement of the interference bar 54 it will be appreciated that the recess 56 becomes aligned with pins 48. The alignment makes it possible for the pins 48 to move radially inwardly into the recess 56 to thereby disengage recess 52 in the housing 36. Pins 48 are encouraged to move radially inwardly, once recess 56 is aligned therewith, by a geometry of tip 50 in combination with a geometry of recess 52. More particularly, tip 50 is pointed and the recess 52 is chamfered. Accordingly, an axial load on the drive plate 46 from the power spring or from the drive bar will cause pins 48 to climb out of recess 52 and disengage drive plate 46 from housing 36, providing the pins are physically permitted to move radially inwardly by alignment of the recesses 56 of the interference bar 54 with the pins 48. At this point the drive plate 46 is free to contact and drive the slip 40 based upon the input from either the power spring or the drive bar thereby preparing the slip for full set by set down weight.

Figure 5:
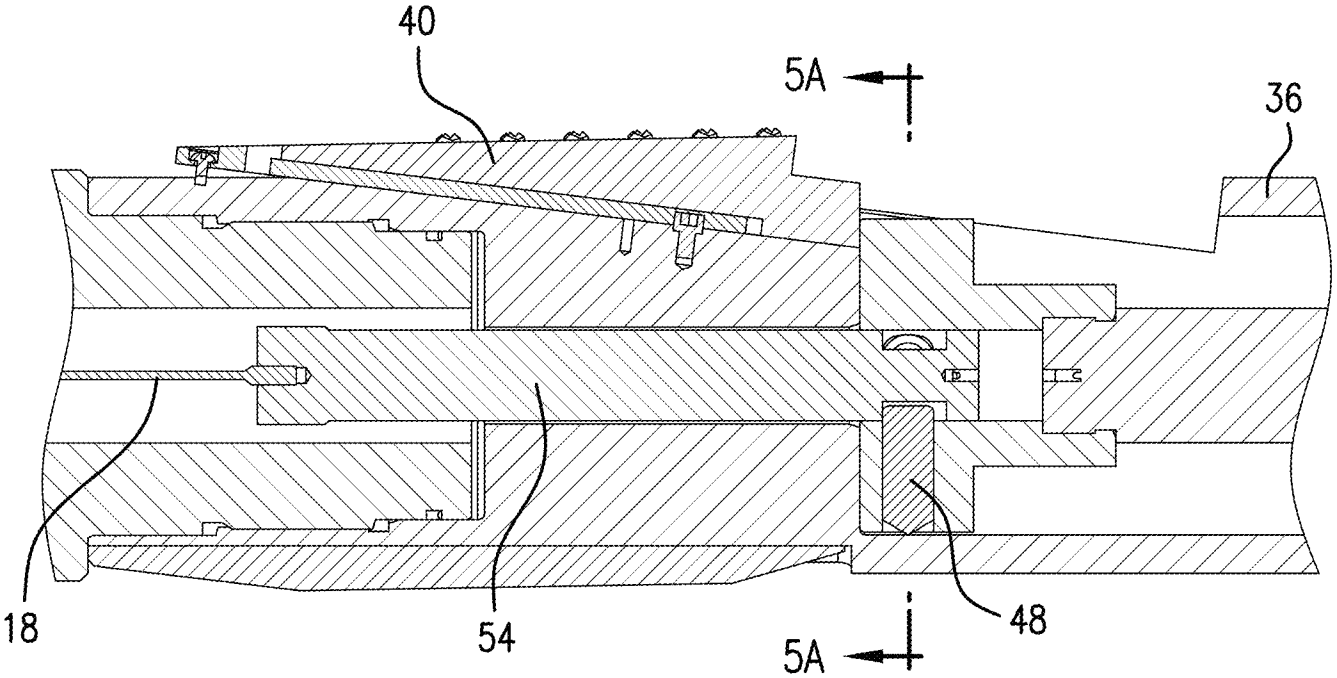
FIG. 5 is a view of the anchor with the interlock completely disengaged and the slip in a set position
Figure 5A:
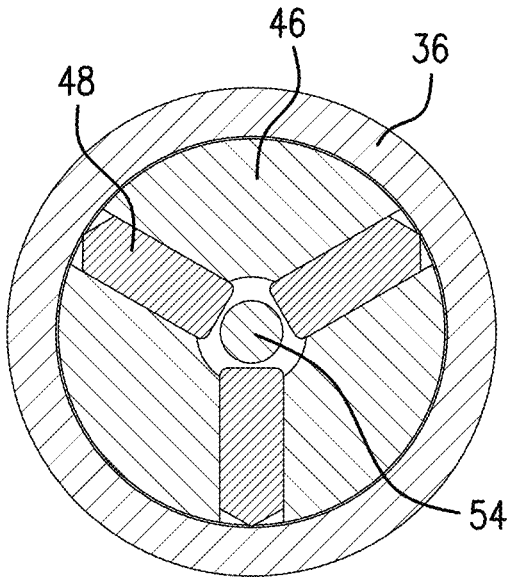
FIG. 5A is a cross section view of the drive plate disengaged from the housing.

FIG. 5 illustrates the slip in a set position and FIG. 5A illustrates the appearance of the pins 48 once they have left the recess 52.

Figure 6:
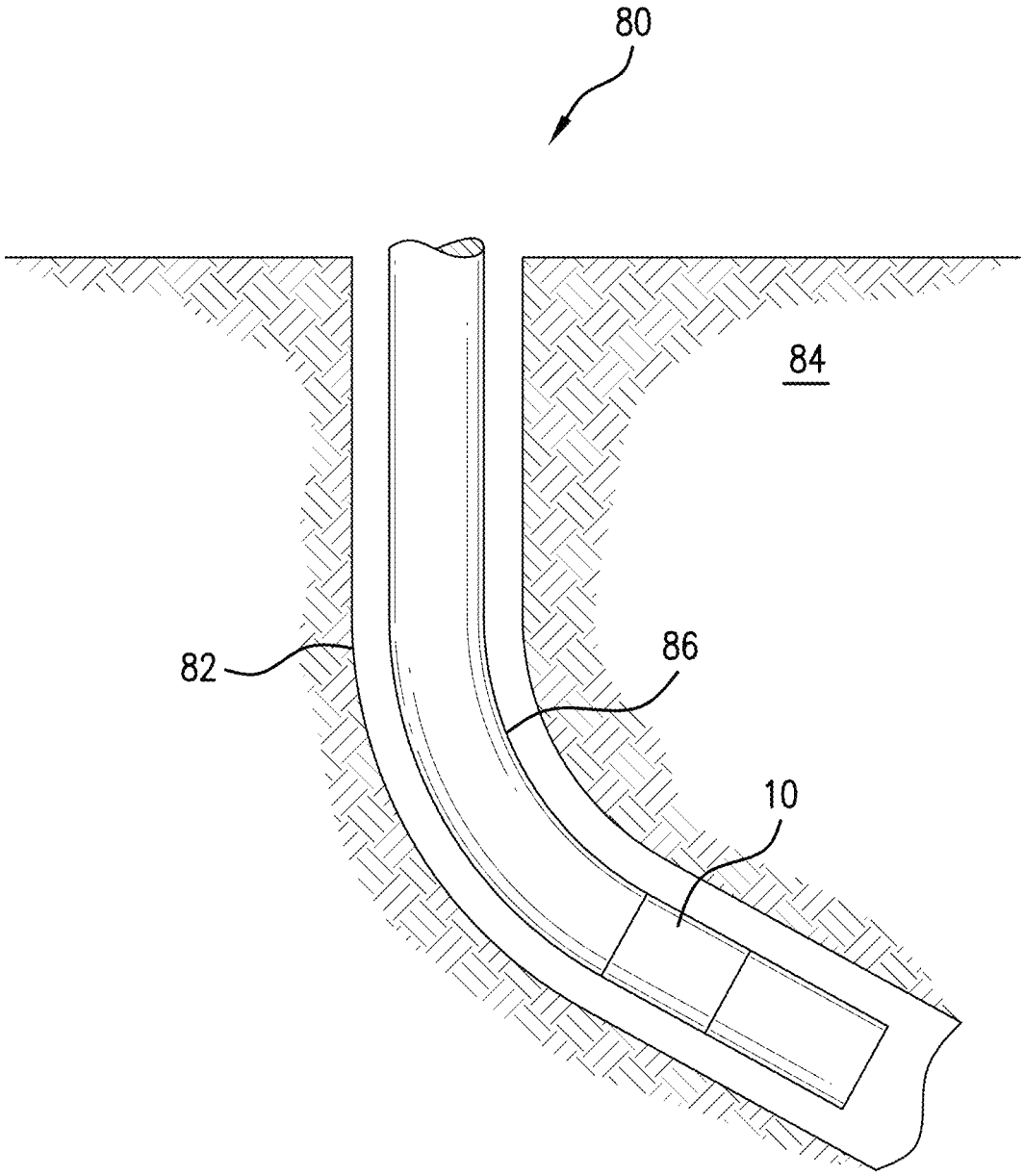
FIG. 6 is a view of a borehole system including a casing exit assembly as disclosed herein.

Referring to FIG. 6, a borehole system 80 is illustrated. The system 80 comprises a borehole 82 in a subsurface formation 84. A string 86 is disposed within the borehole 82. A casing exit assembly 10, as disclosed herein, is disposed within or as a part of the string 86.

Set forth below are some embodiments of the foregoing disclosure:

Embodiment 1: A casing exit assembly, including a whipstock, a mill releasably attached to the whipstock, the mill including an initiation sensor and a drive, and an anchor attached to the whipstock, the anchor including a housing with a ramp, a slip disposed to move radially of the housing upon axially transitioning on the ramp, and an interlock operably attached to the driver.

Embodiment 2: The casing exit assembly as in any prior embodiment, wherein in the sensor is configured to sense one of an inside diameter pressure, and outside diameter pressure of the mill, or both.

Embodiment 3: The casing exit assembly as in any prior embodiment, wherein the drive is a rotary to axial motion converter.

Embodiment 4: The casing exit assembly as in any prior embodiment, wherein the drive is responsive to a signal generated by the sensor.

Embodiment 5: The casing exit assembly as in any prior embodiment, wherein the interlock includes a drive plate having an interference pin.

Embodiment 6: The casing exit assembly as in any prior embodiment, the interlock further including an interference bar attached to the drive and a release member releasably affixing the interference bar to the drive plate.

Embodiment 7: The casing exit assembly as in any prior embodiment, wherein the interference bar is attached to the drive plate through a drive bar with which the release member is connected.

Embodiment 8: The casing exit assembly as in any prior embodiment, wherein the interference bar includes a recess alignable with the interference pin to allow movement of the interference pin.

Embodiment 9: The casing exit assembly as in any prior embodiment, wherein the drive plate maintains potential energy in a power spring of the anchor until release of the interference pin.

Embodiment 10: A method for managing a casing exit, including running the casing exit assembly as in any prior embodiment to a target location in a borehole, sensing a pressure within or around the assembly, imposing a tensile load on the interlock, releasing the interlock, moving the slip with a drive plate of the interlock, and setting the slip.

Embodiment 11: The method as in any prior embodiment, wherein the releasing the interlock includes aligning a recess of an interference bar with an interference pin thereby allowing the interference pin to disengage from the housing.

Embodiment 12: The method as in any prior embodiment, wherein the imposing the tensile load is by pulling with a cable connected to the drive.

Embodiment 13: The method as in any prior embodiment, further including rotating the drive and converting the rotary motion to linear motion to tension the cable.

Embodiment 14: The method as in any prior embodiment, wherein the sensing includes generating a signal to the drive when the sensor senses a threshold pressure.

Embodiment 15: The method as in any prior embodiment, wherein the releasing the interlock includes loading and release member to release the interference bar from a drive bar.

Embodiment 16: A borehole system, including a borehole in a subsurface formation, a string disposed in the borehole, and a casing exit assembly as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A casing exit assembly, comprising:

a whipstock;

a mill attached to the whipstock, the mill including an initiation sensor disposed in a body of the mill, the sensor exposed to pressure radially outwardly of the mill, radially inwardly of the mill, or both, an electronics package disposed in the mill and configured to read a signal generated by the sensor, and a mechanical drive responsive to the electronics package; and an anchor attached to the whipstock and spaced from the mill by the whipstock, the anchor including a housing with a ramp, a drive plate disposed in the housing, the drive plate mechanically connected to the mechanical drive, and a slip disposed to move exclusively through mechanical input of the drive and the drive plate radially of the housing upon axially transitioning on the ramp;

and an interlock operably attached to the drive to mechanically prevent movement of the drive plate until movement of the drive releases the interlock.

2. The casing exit assembly as claimed in claim 1, wherein the drive is a rotary to axial motion converter.

3. The casing exit assembly as claimed in claim 1, wherein the drive is responsive to a signal generated by the sensor.

4. The casing exit assembly as claimed in claim 1, wherein the interlock includes a drive plate having an interference pin.

5. The casing exit assembly as claimed in claim 4, the interlock further including an interference bar attached to the drive and a release member releasably affixing the interference bar to the drive plate.

6. The casing exit assembly as claimed in claim 5, wherein the interference bar is attached to the drive plate through a drive bar with which the release member is connected.

7. The casing exit assembly as claimed in claim 5, wherein the interference bar includes a recess alignable with the interference pin to allow movement of the interference pin.

8. The casing exit assembly as claimed in claim 4, wherein the drive plate maintains potential energy in a power spring of the anchor until release of the interference pin.

9. A method for managing a casing exit, comprising:

running the casing exit assembly as claimed in claim 1 to a target location in a borehole;

sensing a pressure within or around the assembly;

imposing a tensile load on the interlock;

releasing the interlock;

moving the slip with a drive plate of the interlock; and setting the slip.

10. The method as claimed and claimed 9, wherein the releasing the interlock includes aligning a recess of an interference bar with an interference pin thereby allowing the interference pin to disengage from the housing.

11. The method as claimed and claimed 9, wherein the imposing the tensile load is by pulling with a cable connected to the drive.

12. The method as claimed and claimed 11, further including rotating the drive and converting the rotary motion to linear motion to tension the cable.

13. The method as claimed and claimed 9, wherein the sensing includes generating a signal to the drive when the sensor senses a threshold pressure.

14. The method as claimed and claimed 10, wherein the releasing the interlock includes loading and release member to release the interference bar from a drive bar.

15. A borehole system, comprising:

a borehole in a subsurface formation;

a string disposed in the borehole; and a casing exit assembly as claimed in claim 1, disposed within or as a part of the string.

* * * * *